United States Patent [19]

Hutkin

[11] 4,073,699

[45] Feb. 14, 1978

[54] METHOD FOR MAKING COPPER FOIL

[76] Inventor: Irving J. Hutkin, 8983 Complex Drive, San Diego, Calif. 92123

[21] Appl. No.: 662,551

[22] Filed: Mar. 1, 1976

[51] Int. Cl.[2] ..... C25D 1/04; C25D 1/20; C25D 1/22

[52] U.S. Cl. ..... 204/13; 204/208

[58] Field of Search ..... 204/12, 13, 281, 208

[56] References Cited

U.S. PATENT DOCUMENTS

| | | | |
|---|---|---|---|
| 880,484 | 2/1908 | Edison | 204/13 |
| 1,760,028 | 5/1930 | Williams et al. | 204/13 |
| 2,433,441 | 12/1947 | Davidoff | 204/13 |
| 3,151,048 | 9/1964 | Conley et al. | 204/13 |
| 3,398,442 | 8/1968 | Palmer | 204/12 |
| 3,990,926 | 11/1976 | Konicek | 204/15 |
| 3,998,601 | 12/1976 | Yates et al. | 204/12 |

*Primary Examiner*—T. M. Tufariello

[57] ABSTRACT

The improved method of the invention includes depositing, as by electroplating, a coating of porefree copper on a clean fresh plateable layer, such as selected metal oxide, on a surface of a flexible elongated metal strip or belt to form copper foil, stripping the foil from the layer, removing the layer from the belt and reforming it, as by electro-deposition or the like, as a fresh clean layer ready to receive a copper coating as above. The steps of the method are performed in separate treating zones and the method can be continuous.

At least certain of the major treating zones preferably are in duplicate so as to facilitate maintenance thereof without interrupting the continuous production of the copper foil. In one embodiment the copper foil, before it is stripped from the plateable layer, is treated to increase its bondability to plastics. Such bondability is also increased in a separate embodiment by mechanically or chemically roughening a surface of the belt before the plateable layer is formed or reformed thereon. The plateable layer and the copper foil are then deposited on the roughened surface and follow its contours. The roughened surface can also finely control the extent of adhesion between the plateable layer and copper foil.

Apparatus of the invention for carrying out the present method includes a plurality of the described zones, the described layer and belt, and transport means for passing the belt sequentially through the zones. Preferably, the equipment is in large part redundant so that maintenance and repairs can be conducted on a part thereof without interfering with the operation of the present equipment in a continuous mode. Inexpensive high quality copper foil laminates useful in manufacturing electrical and electronic circuitry and the like are provided by the method and apparatus.

12 Claims, 5 Drawing Figures

METHOD FOR MAKING COPPER FOIL

BACKGROUND OF THE INVENTION

1. Field of the Invention

The present invention generally relates to foils and more particularly to an improved method and apparatus for making high quality pore-free copper foil which is readily bondable to plastic substrates.

2. Description of Prior Art

Copper foil has been produced for may years by electrodeposition, the major use for such foil being as roof flashing in the housing industry. Of more importance, however, is the widespread use of electrodeposited copper foil in copper clad plastic laminates for use in the manufacture of printed circuits. For this latter application, the thickness of the copper foil is generally less while the copper foil is required to be free from porosity and of higher purity. As the requirements for printed circuits become increasingly severe because of greater design sophistication, so have the requirements imposed upon the copper foil used in the manufacture of the printed circuit laminates.

Early manufacture of copper foil by electrodeposition was performed on a rotating chromium plated steel drum, in various processes, such are described by Brown in U.S. Pat. No. 2,304,253, issued June 4, 1940. Because of the failure of such processes to control the nature of the oxide surface of the chromium plating on the drum, the copper foil produced on such drums was frequently quite porous and spongy and, therefore, unsatisfactory. Some years later, a slowly rotating drum having a lead surface was used in place of the chromium plated drum.

During the plating process on such a modified drum a portion of the lead surface of the drum was continuously polished by grinding it so as to provide a fresh plating surface for the electrodeposition of the copper foil thereon. This procedure, however, produced copper foil that frequently had fine lead particles from the surface of the drum trapped therein. When used to make printed circuits, such foil had many shorts between copper conducting lements because of the entrapped lead and therefore also was unsatisfactory.

U.S. Pat. No. 3,660,190 to Stroszynski, issued May 2, 1972, describes a procedure for manufacturing a composite material comprising a supporting film or foil and a metal layer bonded thereto. Basically, Stroszynski has combined the art of two conventional manufacturing processes; namely, electrolytic Cu foil formation and roll lamination. His process provides for electrodeposition of a copper layer on a first chrome plated roller and the subsequent transfer to a supporting film carried by an endless rotating intermediate support member, which can take the form of an endless belt on a guide roller or simply a second roller.

The drum surface of the guide or second roller, (as the case may be) performs the function of a pinch roller of the laminating process specifically recited and claimed.

Since the drum surface used for the preparation of the Cu foil is continuously reused as it rotates, it cannot function on a practical and efficient level. In the making of foil, having the specified thickness of 40 to 280 Microinches, it is difficult if not impossible to avoid the occurrence of flaws therein. Due to the presence of such flaws, resin and/or adhesive will be squeezed therethrough onto the drum surface, which will become progressively loaded with such deposits. On subsequent turns, the resin spots on the drum will inhibit copper deposition over ever increasing larger areas, thereby rendering an unacceptable film. Additionally, most resins will also contaminate the copper plating solution used for the electrodeposition. The key concept of Stroszynski is the dual function and reusability of his "endless rotatable surface", which is used as the intermediate support. Applicant is not concerned with this lamination function, but desires to provide a superior foil product free from the above noted flaws.

U.S. Pat. No. 3,151,048 to Conley, issued Sept. 1964, describes an improved procedure for making copper foil on chromium plated drums. The drum used in that procedure is capable of producing relatively pore-free copper foil. However, the process must be stopped and the drum must be periodically removed for expensive time-consuming regrinding and/or replating with chromium before it is reusable. Therefore, such process does not lend itself to long-term continuous production of high quality copper foil.

In the period from 1940 to the present, there have been many other attempts to improve, not only the drum material, but other parts of the apparatus, mostly with little success. The need has been recognized to overcome basic drawbacks inherent in the drum configuration in order to produce more economically a stringently controlled high quality copper foil. Thus, the electroplating current has been maximized in order to produce copper foil at a reasonable rate, since the foil is produced only on a portion of the surface of the drum, and the drum surface is relatively small. The total desired foil thickness so produced must be regulated by controlling the drums rotating speed.

After the desired copper foil thickness is electroformed, the foil is peeled from the drum surface and is wound onto a roll for further treatment, since the drum surface is needed in the manufacture of further copper foil. That surface of the copper foil so formed away from the drum, i.e. the side away from the drum surface, is quite rough and is usually treated further in a separate operation away from the drum in order to impart to it microscopic projections which enhance subsequent bonding of the copper foil to plastic substrates in conventional laminating processes.

The treatment applied to the rough surface of the copper foil to enhance its bondability is performed in a separate treatment machine and as a separate operation with a constant copper foil speed through the treatment machine, in contrast to the copper foil speed during its drum formation, which varies widely because of the different final copper foil thicknesses required. Therefore, the copper foil formation operation and the subsequent surface treatment, thereof, could not be combined into a single operation.

Accordingly, there is still a need for an improved method and apparatus for the production of high quality copper foil for printed circuits, which foil can be readily bonded to plastic. Such method should be capable of being operated at a constant speed and of effectively combining copper foil formation and surface treatment thereof. Such method should also be capable of maximizing the yield of pore-free copper foil suitable for laminates to be used in the maufacture of printed circuits. Preferably, such method should be capable of being used in a continuous long-term mode without requiring shut-down or slow-down and without any substantial variation in product quality.

Conventional processes, as noted above, require frequent shut-down of the apparatus to renovate the drum surface by remachining and/or replating, which raises the cost of the product. Such renovating, however, is necessary in order to avert substantial damage to the operating drum and the production of inferior product. Moreover, anodes of the nonconsumable type are employed in present apparatus, which anodes are shaped to closely follow the contour of the drum. Copper-rich plating solution is fed between the drum and anode surfaces causing erosion of the anodes thus requiring regular shut-downs and disassembly of the apparatus for anode replacement.

The desired method also should consistently yield copper foil of the highest pore-free quality. Current processes, in order to achieve good production economics and to attain reasonable foil production speed from the plateable drum surface, employ current densities usually very close to the maximum permissible for the equipment and plating conditions. The result often is unsuitable copper foil, thereby lowering overall production yields.

SUMMARY OF THE INVENTION

The present method and apparatus satisfy the foregoing needs. Such method and apparatus are generally as set forth in the Abstract above. Thus, a high quality pore-free copper foil can be continuously made at low costs over a very long period of time, without variation in quality, in accordance with the present method.

The present invention involves the use of a strip, preferably, an endless metal belt, that replaces the conventional drum surface to receive, support, and transport the electrodeposited copper foil. The apparatus in which the metal belt is, in turn, transported contains a multitude of containers or tanks through which the belt is drawn to process it. By utilizing the correct sequence of cleaning, rinsing, plating, and treatment solutions in the apparatus, the surface of the belt can be continuously cleaned of copper foil debris and then chemically activated to receive an electrodeposited pore-free layer of the copper foil.

Following the complete formation of the desired foil thickness, the belt in a preferred embodiment carries the foil to a series of tanks, in which a so-called "oxide treatment" or the like is applied to the exposed copper surface so as to produce projections thereon which increase its bondability to plastics. The treated foil is then rinsed, dried, and peeled away from the belt and wound on a storage roll. The area of the belt from which the copper foil has been stripped is then transported back to the starting point of the apparatus to again be cleaned and prepared for copper foil deposition.

In this manner clean, freshly prepared plateable layers or surfaces are constantly being produced on the belt so as to receive the electrodeposited copper foil without generating any defect in the copper foil. The surface of the belt itself before (re)generation of the fresh clean plateable layer thereon can be roughened, so that the copper foil thereafter deposited thereon will also be rough and more readily adhere to such plastics and to the layer. Any undesired defects that appear on the belt surface, such as scratches, burn marks, or adhering debris are removed and replaced with the fresh, clean plateable layer.

All such steps take place as the belt continues to move and produce foil without interruption. It is preferred to incorporate duplicate equipment at, at least, certain points in the apparatus so that repairs and maintenance thereof will not necessitate either halting or slowing down the copper foil production. Thus, inexpensive, high quality pore-free copper foil, which readily bonds to plastics, is produced. Further advantages are set forth in the following detailed description and accompanying drawings.

DRAWINGS

Figure 3:
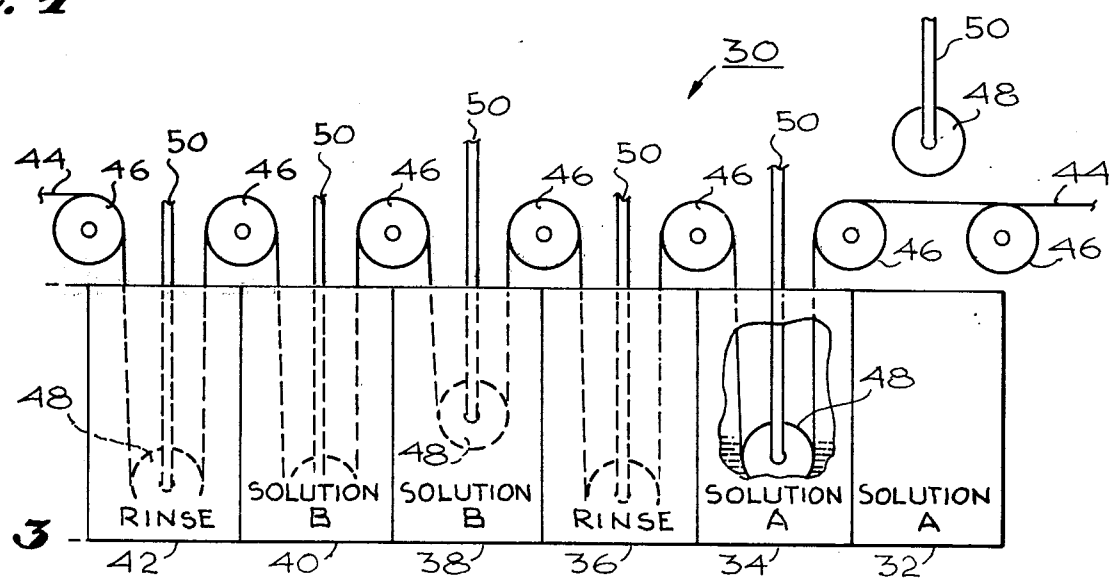
Figure 4:
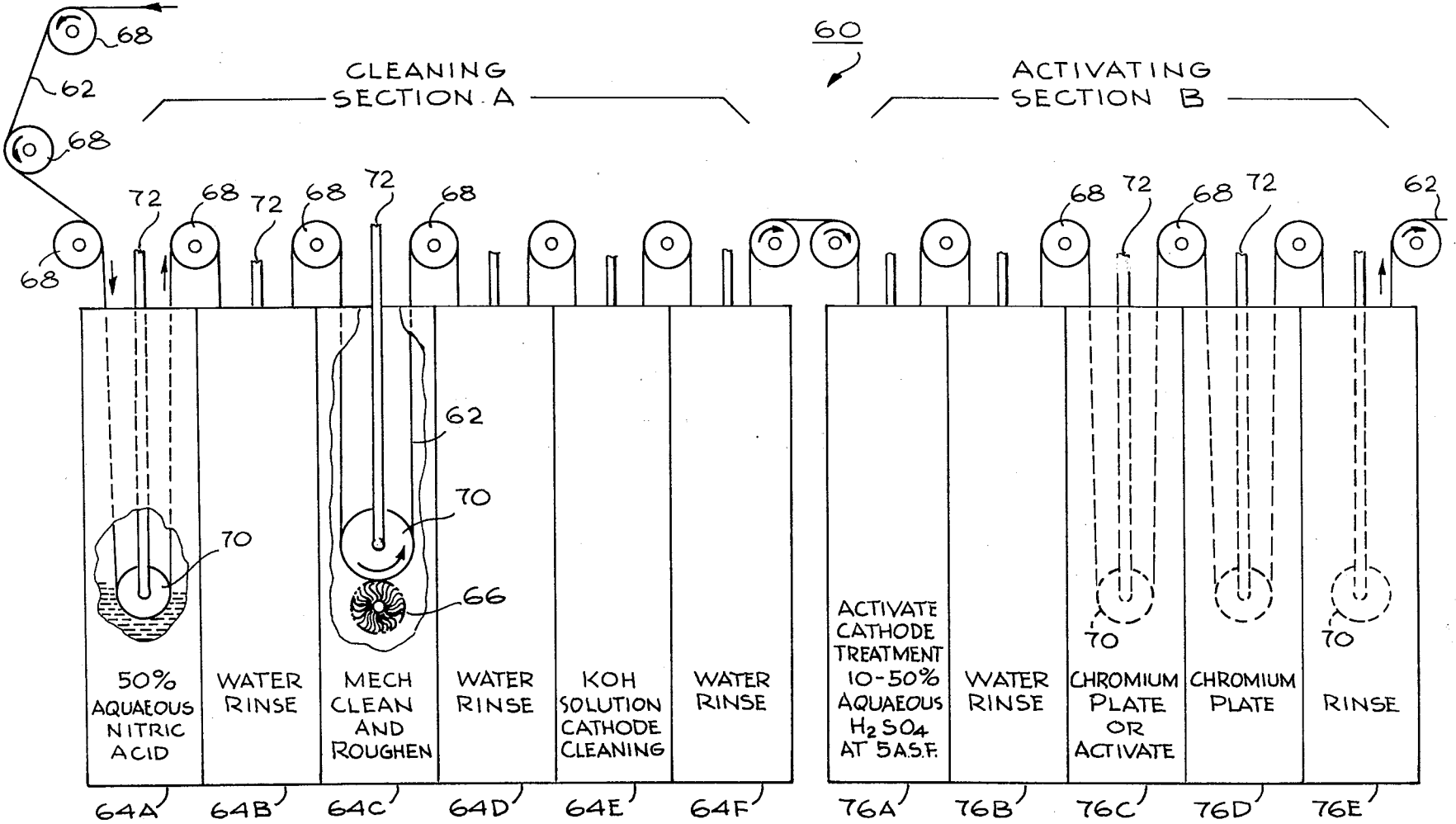
Figure 4A:
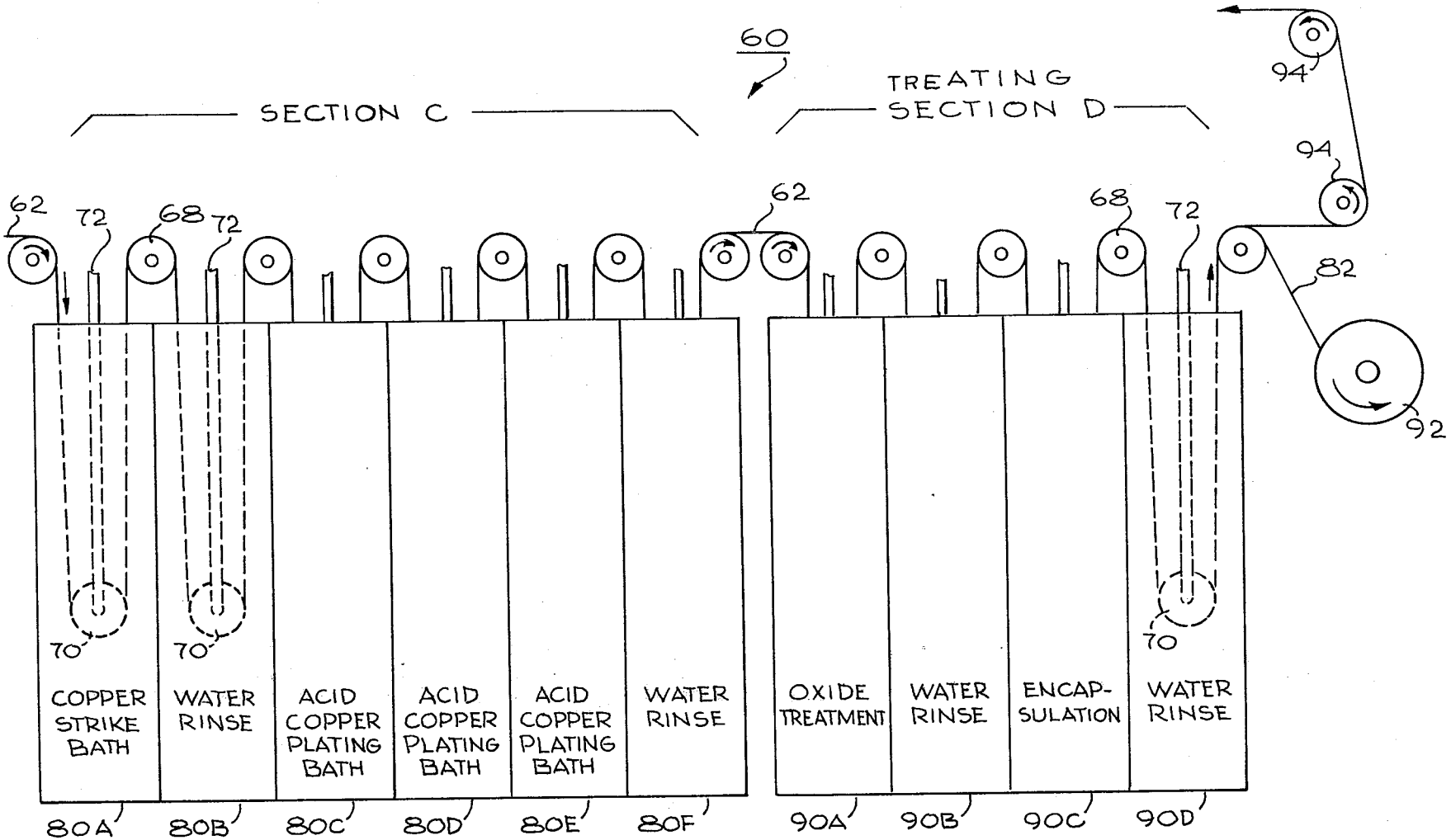

FIG. 3 is a schematic side elevation, partly broken away, illustrating a portion of a second preferred embodiment of apparatus of the invention for carrying out the method of the present invention; and FIGS. 4 and 4A are a schematic side elevation, partly broken away, illustrating a third preferred embodiment of the apparatus of the invention for carrying out the method of the present invention, Section A, thereof, illustrating cleaning equipment, Section B, thereof, illustrating activating equipment, Section C, thereof, illustrating copper electroplating equipment and Section D, thereof, illustrating copper bondability enhancing equipment.

The improved method of the present invention is utilizable for the efficient manufacture of high quality, pore-free copper foil. Although the present method does not have to be carried out in the improved apparatus of the present invention, embodiments of which are schematically illustrated in the accompanying drawings, such method is least described in detail in connection therewith. The method involves depositing a coating of pore-free copper on a clean, fresh plateable layer on a surface of a flexible elongated metal strip or belt (web) to form the desired copper foil. The foil is stripped from the belt and recovered, while the belt is refurbished by removing the plateable layer therefrom and generating a new, fresh, clean plateable layer thereon. The advantages of the present method are best enjoyed when the present method is operated in a continuous mode and for the purpose, it is preferred that the steps thereof be carried out in separate zones which can be provided in duplicate so as to permit maintenance and repair thereof without stopping or slowing the formation and recovery of the uniformly high quality copper foil product.

DETAILED DESCRIPTION

Figure 1:
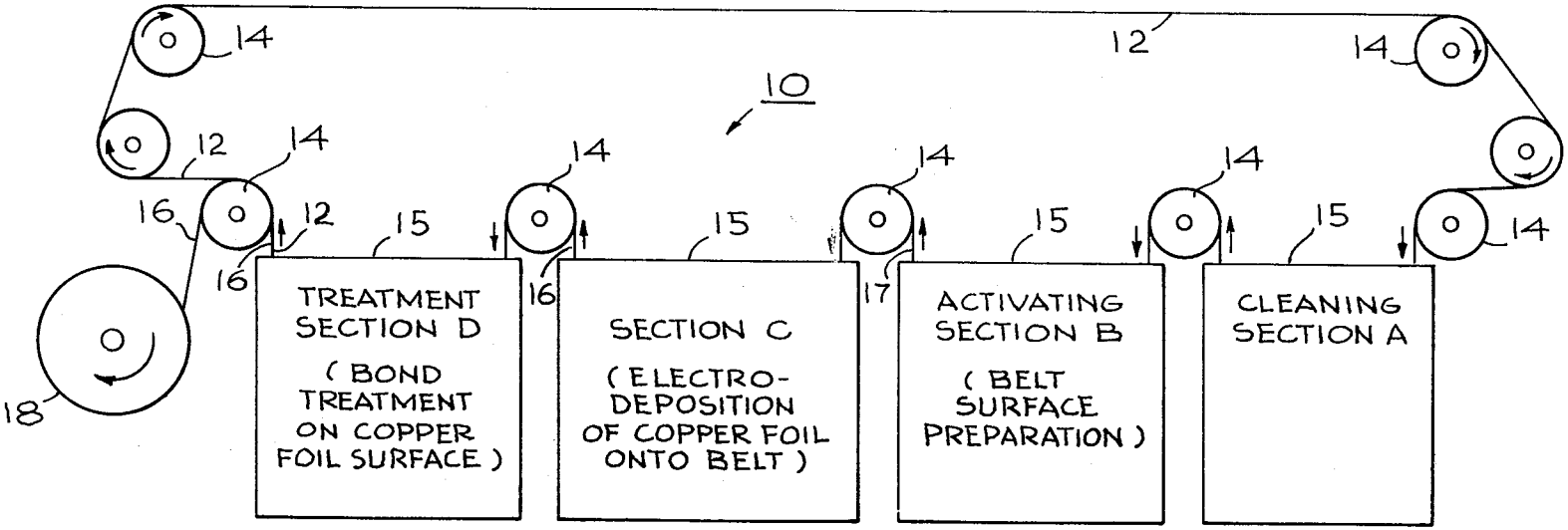
FIG. 1 is a schematic side elevation of a first preferred embodiment of apparatus of the invention for carrying out the method of the present invention.
Figure 2:
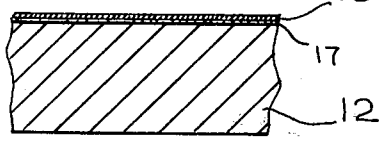
FIG. 2 is a schematic enlarged fragmentary cross section of a belt with plateable layer as used in the apparatus of FIG. 1.

FIGS. 1 and 2

FIG. 1 shows a preferred embodiment of the apparatus of this invention in schematic side elevation. Thus, apparatus 10 is shown which includes an endless metal belt 12 carried in a closed loop by a series of rollers 14 through containers or Section A, B, C, and D in that order. It should be noted that the four sections each comprise groups of open-topped tanks 15, wherein the various plating, cleaning, treating, and/or rinsing functions of the present method are carried out.

Thus, Section A is that in which belt 12 is cleaned of debris, burn marks, etc., by immersion of belt 12 into appropriate chemical solution. In Section B a plateable surface layer of belt 12 is first stripped from belt 12 and then reapplied to it to provide a fresh, active surface layer for receiving the electrodeposited copper foil 16, that is applied thereto in Section C. As belt 12 emerges from the end of Section C, electrodeposited copper foil 16 adheres to layer 17 and is transported therewith through Section D, wherein a treatment is applied to the exposed copper foil surface to enhance its bondability to plastics.

After leaving Section D, copper foil 16 and belt 12 (with layer 17) are separated and dried, copper foil 16 then being wound on to a take-up reel 18 while belt 12 then returns to Section A, so that apparatus 10 can be run in a continuous mode.

Belt 12 is of selected metal which bears layer 17, the latter being a thin fresh oxide layer onto which copper can be electrodeposited by nucleating on many closely spaced sites on layer 17 and rapidly spreading together to form the desired continuous copper pore-free foil 16. It is important to note that not only must layer 17 permit and facilitate the nucleation and formation of pore-free copper foil, but the layer 17 also must not be strongly adherent to foil 16, so that easy separation of foil 16 and belt 12 can be later accomplished.

One metal that is considered suitable as belt 12 is stainless steel since it can either be used to generate layer 17 or it can receive layer 17 deposited as another metal. Thus, for example, a stainless steel belt can be cleaned in Section A so as to remove its natural oxide and then cause it to be freshly replaced in Section B.

As a second example, a stainless steel belt can have a layer of crack-free chromium electrodeposited on it, in a conventional procedure, in Section B. The fresh layer of chromium generates a more suitable, uniform fresh oxide layer for copper electrodeposition than does heterogeneous stainless steel.

In place of the chromium, a plated layer of nickel or cobalt can be electrodeposited, although chromium is preferred. The nickel yields a nickel oxide layer 17 and the cobalt, a cobalt oxide layer 17. Other metals that can be used for belt 12 because they can generate a controlled plateable oxide layer, are aluminum, titanium, and various alloys, or mixtures of these metals. Metals that can be used as belt 12 upon which chromium can be plated comprise the same group plus such metals as copper, brass, bronze, alloy, or mild steel, iron, lead and the like.

Belt 12 most preferably is a seam-free continuous loop of mild steel, stainless steel, copper, brass, or aluminum upon which is plated over its entire surface a layer of crack-free chromium which forms layer 17 of chromium oxide. The thickness of belt 12 can range from about 1 mil up to about 100 mils, depending upon the metal chosen, the temper of the metal, and the size of rollers 14 used in apparatus 10.

It has been found desireable that the plateable layer on belt 12, onto which layer the copper layer is to be electrodeposited, be rough in texture. The purpose of this roughness is to provide some mechanical adhesion between electroplated copper foil and the plateable layer to hold these together during processing and transportation since the fresh chromium oxide on the belt provides a readily plateable and readily releasable surface for the copper foil.

The roughness of the plateable layer is achieved by making belt 12 rough. Such roughness should not cause small areas of the copper foil to be torn away when separating the foil from the plateable layer. Thus, the belt surface and plateable layer should have a microscopic surface configuration ideally resembling pyramidal projections that are about 0.1 to 0.5 mils in height.

Other roughened surface configurations having open recesses are also suitable. The roughness necessary depends on the design of the processing equipment. In general, however, the peel strength between the copper layer and the plateable layer-coated belt surface should range between 0.1 to 2.0 lbs./in width.

Prior to depositing the chromium oxide or other plateable layer, the belt 12 can be mechanically roughened by wire brushing or by sand blasting its surface. Chemical etching and/or anodic etching techniques can also be used to roughen the surface of belt 12. Such macroetching techniques are well known to those skilled in the art. When properly roughened, the formerly smooth surface of the belt 12 will appear to have a matte or frosted finish. Such roughening may also enhance the bondability of the electroplated copper foil layer to plastics.

FIG. 3

A second preferred embodiment of the apparatus of this invention is schematically shown in part in FIG. 3. Thus, FIG. 3 shows apparatus 30 which includes a series of tanks 32, 34, 36, 38, 40, and 42. Tanks 32, 34, 38, and 40 are treating solution tanks. Tanks 32 and 34 contain some solution (A) while tanks 38 and 40 each contain a second treating solution (B). Each pair of the treating solution tanks is followed by a rinse tank. Thus, tanks 32 and 34 are followed by rinse tank 36 and solution tanks 38 and 40 by rinse tank 42. A metal belt 44 is transported from tank to tank by means of roller 46 positioned over the top of each open-topped tank. Rollers 48 are also provided which are positionable at the bottom of each tank, and are attached to racks 50 that can be raised to a position above the tank or can be lowered into the tank. In this way, the dwell time of belt 44 in each tank can be controlled and it is also possible for belt 40 to bypass a tank entirely, as shown with tank 32. This arrangement provides a redundancy of solution in separate tanks so that periodic cleaning and maintenance of the treating tanks can be done without interrupting production of copper foil.

To remove a tank from service, the rack 50 associated therewith need only be raised so that belt 44 is above the tank. Another tank having the same solution receives belt 44, by lowering its associated rack 50 for the required solution dwell time. Rollers 46 and 48 can be drive rollers or non-powered rollers. Fixed (non-rotating) guides could also be used in place of rollers 46 and 48. Rollers 46 and 48, can also serve as electrical contacts for belt 44 in electroplating tanks and in that case, metal rollers are used. If rollers 46 and/or 48 are motor driven, belt 44 can be transported at constant speed with a minimum of residual tension.

It is not essential that all tanks or even sections of tanks be employed continuously. Intermittent or periodic use of all sections is anticipated, except for the copper electrodeposition (Section C, FIG. 1), which can be expected to function continuously. Under certain conditions, cleaning Section A (FIG. 1) can be bypassed when little debris is being generated and no damage is occurring to belt 12, during copper foil production.

Similarly, it may be advisable to operate Section B on an intermittant basis so as to remove and replace layer 17 only after a pre-determined number of passes, rather than after each one. Finally, the bond enhancing treatment applied in Section D (FIG. 1) may be undesirable for some copper foil applications, in which case, Section D could be bypassed.

FIGS. 4 and 4A

FIGS. 4 and 4A is schematically depicted a third embodiment of the present apparatus. Thus apparatus 60 is depicted which differs from the functional description of apparatus 10 in that it incorporates a mechanical belt roughening equipment as well as copper striking equipment. Moreover, some redundancy is shown as also appears in apparatus 30. It will be understood, that such redundancy usually is desirable.

Section A, in FIG. 4, is that in which cleaning of a metal belt 62 is accomplished. The type of debris that can be expected on belt 62 is copper and copper oxide particles with or without zinc (from an "oxide treatment") and also dried plating solution or treatment salts. Damage to belt 62 most often will take the form of burn marks. Chemical methods for removal of these from belt 62 are well known to those skilled in the art. A variety of proprietary cleaning products are also available for this purpose.

Some chemicals that are useful for cleaning a chromium plated belt 62 or stainless steel belt 62, for example, include nitric acid to remove zinc, copper, and copper oxide. Chromium oxide and other metal oxides can sometimes be removed by immersion of belt 62 in a strong aqueous hydrochloric acid solution or in a chromic acid sulfric acid aqueous mixture. Since these may also etch the chromium metal layer, it may be desireable to remove chromium oxide cathodically (electrocleaning) in an alkali or in a weak acid.

FIG. 4 shows a series of six open-topped tanks 64, in Section A, the first tank 64A containing nitric acid (e.g. 50% aqueous solution) and the second tank 64B a water rinse. In the third tank 64C, a conventional rotating buffing wheel 66 is used to remove adherent deposits, oxides, or other debris from belt 62.

Wheel 66 also can be used to periodically fine polish or regrind belt 62 in place without interruption of copper foil production. The mechanical cleaning and/or polishing in the third tank 64C can utilize, for example, abrasive loaded wheels or wire brushes and can be done either dry or wet.

Alternatively, mechanical cleaning and/or surface activation can be carried out using abrasive particles in liquid suspension in the third tank 64C through which belt 62 is drawn. Ultrasonic agitation of such cleaning particles against the surface of belt 62 will also cause good mechanical cleaning or polishing of the belt's surface.

A water rinse unit is disposed in tank 64D to remove cleaning particles from belt 62.

In the fifth tank 64E is cathodic cleaning equipment disposed in an aqueous potassium hydroxide solution (e.g. 15%) to remove residual oxides or cleaning abrasives from belt 62. The sixth tank 64F incorporates a final water rinse.

The preferred sequence for cleaning Section A is shown in FIG. 4. Thus, a chromium plated belt 62 passes through nitric acid, a water rinse, and then a mechanical cleaning. After belt 62 is rinsed, a cathodic cleaning in aqueous in alkaline solution of KOH is effected to remove residual oxides and abrasives. A final water rinse precedes the entry of belt 62 into Section B.

Belt 62 is supported on and transported by a series of rollers 68, above tanks 64 and a series of rollers 70 disposed in tanks 64, the latter attached to racks 72 and movable thereforth to a position above tanks 64, if desired.

The primary function of Section B is to provide a fresh, active plateable layer on belt 62 onto which layer sound, pore-free copper can be subsequently electrodeposited. In this regard, a series of five tanks 76 are schematically illustrated in FIG. 4, in which the cleaned belt 62 is first activated (to remove the naturally occurring passive oxide film therefrom), and after rinsing, is replated with a fresh, active chromium layer (to produce a fresh surface of chromium oxide) or else a plateable oxide layer of the belt 62 itself, for example, a fresh, stainless steel oxide (consisting of mixed oxides of chromium, nickel and iron) is chemically reformed.

FIG. 4, Section B, shows a typical sequence in which surface activation of belt 62 is carried out in the first tank 76A, using a cathodic treatment at room temperature in 10 – 50% sulfuric acid at 5 amps/sq. ft. Alternatively, an immersion in dilute aqueous sulfuric acid-hydrochloric acid mixture can be used or else an anodic treatment or an immersion in chromic acid solution.

Rollers 68 and 70, and racks 72 support belt 62 in Section B, as they do in Section A.

Belt 62 next passes through a water rinse (second tank 76B) and is then treated by electrodepositing thereon the desired metal layer preferably chromium. This occurs in the third and fourth tank of Section B. These two tanks, 76C and 76D, are identical; that is, each contains a chromium plating solution so that either can be bypassed for repair or cleaning without stopping the operation of apparatus 60.

If either chromium plating tank 76C or 76D is removed for renovation, then the rack length in the remaining chromium tank (76C or 76D) can be increased to provide an equivalent total plating time.

If the activation tank (first tank 76A) must be serviced, then activation can take place in the chromium solution in the third tank 76C. This is done simply by passing belt 62 through the chromium solution without current or, if insufficient, utilizing a low current cathodic treatment in the solution of the third tank 76C.

There are several chromium plating solutions that are suitable for apparatus 60. The best known aqueous chromium bath has 40 – 50 oz./gal. of $CrO_3$ and 0.5 oz./gal. of $H_2SO_4$. This can be operated from room temperature (70° F.) up to 150° F. and with current densities from 10 a.s.f. up to several hundred a.s.f. Anodes are typically lead or lead alloy and are nonconsumable. Therefore, periodic additions of chromium as $CrO_3$ must be made to the chromium bath in the third and fourth tank, 76C and 76D.

The chromium plating operation, when operated at room temperature, produces a relatively crack-free chromium layer on belt 62. Other methods of depositing suitable chromium layers (which form chromium oxide) are given in U.S. Pat. No. 1,967,716 to Mahlstedt and in U.S. Pat. No. 2,686,756 to Stareck, among others.

When a chromium layer is continuously produced on belt 62 surface, such layer must be kept from becoming too thick, as may occur during successive passes. The amount of chromium added to belt 62 on each pass, however, can be easily controlled by electroplating conditions, such as temperature and current density, so that it is balanced by the amount of chromium removed from belt 62 during the cleaning and activation steps.

When the surface layer of belt 62 is of a metal other than chromium, it can still be activated in Section B. Thus, Section B can be used to activate or remove the surface layer of a stainless steel, aluminum, or other oxide forming metal belt and then can be used to replace the oxide with a fresh, plateable oxide layer.

Activation solutions in the first tank 76A can be as listed above when a stainless belt is used, but when the belt is aluminum, then an alkaline etch in aqueous KOH according to known practice or in a commerical zincating solution should be substituted. For titanium, activation in hot aqueous HCl or in an aqueous mixture of chromic acid and hydrochloric acid is recommended.

For all these metals the oxides will reform naturally even in water but they can be controlled better by immersion or anodic treatment in sulfuric, nitric, phosphoric, or chromic acid or in mixtures of these acids. If an aluminum belt is zincated in the first tank 76A, then the zinc layer should be removed in third and fourth tanks 76C and 76D by immersion in aqueous nitric acid.

In plating Section C of apparatus 60, the freshly prepared belt surface is plated with copper to form the desired pore-free foil. This can be done using a single main electroplating step carried out in one or more stages. However, apparatus 60 provides means for using two different copper plating solutions; that is, a strike is provided in the first tank 80A of a series of six tanks, 80A,80B,80C,80D,80E, and 80F, followed by a build-up in subsequent tanks 80C,80D, and 80E the copper to the desired foil thickness.

If belt 62 has a plated chromium layer thereon, then copper foil 82 can be formed thereon from a single acid copper plating solution disposed in third tank 80C and in the fourth and fifth tank 80D and 80E), the formula of which can be any one of a number of formulas known to those versed in the art. Thus, a typical aqueous acid copper bath in third tank 80C consists of 27 oz./gal. of copper sulfate and 10 oz./gal. of sulfuric acid.

Additives may be used in the acid copper bath to cause the copper foil electrodeposited to exhibit selected crystal properties. Thus, the copper so deposited can be controlled so that it exhibits columnar crystals or equiaxed crystals. The smoothness of the exposed copper surface so formed can also be controlled, all is known in the art. Small additions of gelatin, phenylsulfonic acid or animal glue promote columnar formation of copper crystals, while additions of thiourea, molasses or dextrin promote a smooth deposit of equiaxed crystals.

The plating current density used in the copper electrodeposition step carried out as the third, fourth, and fifth tanks 80C,D, and E can vary widely. Although, not necessary, it is desirable to carry out the copper electrodeposition in a series of stages and tanks 80. This represents only a relatively insignificantly small cost increase over the use of a single tank 80.

Moreover, the required copper foil thickness can be obtained using current densities in the series of tanks 80C,D, and E, in the center of the accepted plating ranges, rather than the high end, as required by a drum type of apparatus because of the limits of time and space.

Current density can be selected, therefore, to provide the best copper foil properties rather than for economic production of heavy foils. The use of lower current densities also eliminates the need to maintain critical dimensions between the anodes and the copper foil (cathode) during the electrodeposition, and therefore, either consumable or nonconsumable anodes can be used. It will be understood that the number of copper electrodeposition tanks can vary within the parameters and for the purposes indicated above.

On some belt materials such as aluminum, titanium, or stainless steel, it is desirable to first deposit an initial small layer of copper onto the belt surface from a "strike" bath, as noted above. A Rochelle-type copper cyanide strike solution can for example be used at about 40° C. A typical aqueous solution (Bath A) contains:

5.5 oz./gal. of copper cyanide
6.6 oz./gal. of sodium cyanide
4.0 oz./gal. of sodium carbonate
8.0 oz./gal. of rochel salt This solution can be used under a current density of 25 a.s.f. to produce an initial dense non-porous copper layer on the oxide surface of belt 62. After rinsing off such solution in the second tank 80B, belt 62 is subjected to a build-up of copper to the final foil thickness in the acid copper plating bath in the third, fourth, and fifth tanks, 80C through 80E.

Transportation of belt 62 is effected by rollers 68 and 70 and racks 72, as previously described. The acid copper plating solution is rinsed off in water in the sixth tank 80F after which belt 62 passes to Section D.

As shown in FIG. 4, there is a sufficient excess of acid copper plating tanks 80A,C,D, and E, so that large thickness foils can be manufactured in apparatus 60 without altering the speed of belt 62. Anodes can be either consumable or nonconsumable or used in combinations, since no shut-down is required to clean or replace anodes.

As in the other sections of apparatus 60, any given rack 72 is simply raised to cause a tank to be bypassed so that it can be cleaned or an anode can be replaced, all without interrupting continuous operation of apparatus 60.

The final portion of apparatus 60 is shown in treatment Section D in FIG. 4A. To enhance the bondability of copper foil 82 to a plastic substrate, microscopic projections of copper and copper oxide can be electrochemically produced on the exposed copper surface, by a method known to those skilled in the art as "oxide treatment".

In such treatment, excessive current density is used for the copper bath chemistry, temperature and agitation. The resulting deposit consists of microscopic particles of mixed copper metal and copper oxide projecting from the exposed copper foil surface. Typical "treatments" of this type are described in U.S. Pat. No. 3,220,897 (1965) to Conley and U.S. Pat. No. 3,699,018 (1972) to Carlson.

More recently, it has been found that improved results can be obtained if the oxide treatment is followed by a cycle in which a small amount of sound copper or other metal is deposited over the oxide to encapsulate it. A typical "oxide treatment" bath can be disposed in the first tank 90A of Section D and may comprise an aqueous solution of 6 oz./gal of copper sulfate and 13 oz./gal. of sulfuric acid. The oxide treatment can be carried out at room temperature with a current density of 110 a.s.f. for approximately 30 seconds.

After belt 62 is rinsed in the second tank 90B in Section D, encapsulation of the oxide can be done in the third tank 90C in Section D using a bath of the same chemistry, for example, as the acid copper build-up in tanks 80D,E, and F of Section C. A current density of 25 a.s.f. for two minutes will provide the needed encapsulation.

After a final rinse of the encapsulated copper foil in the fourth tank 90D, foil 82 and belt 62 can be dried and then foil 82 can be peeled from belt 62, as shown in FIG. 4 and wound up on a take-up reel 92, while belt 62 can be shunted by guide rolls 94 back to Section A for reuse in a continuous mode.

As a first specific example, this apparatus of FIG. 4 and 4A is operated in a continuous mode using a chromium layer on an endless steel belt (5 mils thick). In Section A, the belt is passed successively through a 50% nitric acid bath and water rinse and is then buffed by a rotary wheel using a silicon carbide abrasive. The nitric acid and abrasive wheel removes debris and surface imperfections. After a water rinse, the buffed belt is cathodically cleaned in aqueous KOH (10%) at 50 a.s.f. for 60 seconds and then water rinsed and passed by rollers to Section B.

In Section B, the belt is activated (to remove surface oxides) at 5 a.s.f. cathodically in 30% aqueous $H_2SO_4$, water rinsed and then electroplated with chromium to about ½ mils thickness in an aqueous bath having 50 oz./gal. of $CrO_3$ and 0.5 oz./gal. of $H_2SO_4$ at 70° F. and 50 a.s.f., using lead anodes. It is then water rinsed and passed to Section C.

In Section C, it is plated with copper by electrodeposition in the successive tanks, each tank including an aqueous plating bath at 70° F. containing 27 oz./gal. of copper sulfate and 10 oz./gal. $H_2SO_4$. A current density of 100 a.s.f. is applied for four minutes in each of the three tanks to produce a typical pore-free copper foil in a thickness of 1 oz./sq. ft.

The copper foil thus formed is moved on the belt to Section D where it is subjected to an "oxide treatment" in an aqueous bath having 6 oz./gal. of copper sulfate and 13 oz./gal. of $H_2SO_4$ at 70° F, and 110 a.s.f. for thirty seconds. The projections formed on the exposed surface of the copper foil are then encapsulated in Section D utilizing a bath having the same composition as those in the three described tanks of Section C, at 70° F. and 25 a.s.f. for 2 minutes.

The finished copper foil is then continuously stripped from the endless belt and wound up on a storage reel while the belt continuously returns to Section A for reprocessing. A very high quality copper foil is obtained continuously since each of Sections A, B, C and D have some duplicate components, as described above.

In a second test, copper foil of essentially the same quality as that of the above specific example is produced utilizing a stainless steel belt bearing a nickel oxide plateable layer. The same procedure is used in the apparatus of FIG. 4, except that the nickel oxide layer is removed by the following cleaning solution, at a temperature of 170° F.:

2 oz./gal. of hydrochloric acid
13 oz./gal. of sulfuric acid
13 oz./gal. of ferric sulfate (anh.)

Moreover, the nickel oxide is generated by nickel freshly electroplated on the stainless steel belt from an aqueous Watts bath containing the following components:

Nickel Sulfate — 45 oz/gal.
Nickel Chloride — 6 oz/gal.
Boric Acid — 5 oz/gal.

The nickel electroplating is carried in a Watts nickel bath at 60 a.s.f. for eight minutes at 120° F. to deposit a nickel layer about 4/10 mils thick.

In a parallel test, cobalt oxide is found to perform similarly to nickel oxide as the plateable layer and is electrodeposited by a well known procedure.

Similar tests, performed in the same manner as above, but substituting belts of aluminum, nickel, copper, brass and titanium for stainless steel and fresh plateable oxide layers of these metals or of chromium provides similar results to those set forth above.

Accordingly, the apparatus described above can be used with great efficiency to carry out the present method. Such method has the advantage over previously known methods in permitting a steady and continuous rate of production of highest quality pore-free copper foil over very long periods of time with a minimum of waste, and at moderate current densities. Such product can be provided at a minimum of expense and can exhibit increased bondability to plastics, so that it need not be further treated before it is laminated thereto. The increased bondability can be effected by a so-called "oxide treatment" and/or mechanical roughening of the transport belt used in the method. Various other features and advantages of the present method are as set forth in the foregoing.

Various modifications and changes can be made in the present method in its parameters and steps, and in the present apparatus, its components, and parameters. All such modifications and changes as are within the scope of the appended claims form part of the present invention.

What is claimed and desired to be secured by Letters Patent is:

1. An improved method of continuously making high quality pore-free copper foil, said method comprising:

a. moving into an operative position an endless, continuous belt, said belt comprising a metal selected from the group of stainless steel, aluminum, nickel, titanium, copper, brass, bronze, or alloys thereof, or mild steel, iron, lead or alloys thereof;
b. electro-chemically depositing in a deposition zone a clean fresh, removable, endless, seamless and continuous plateable layer of metal selected from the group of chromium, nickel and cobalt;
c. depositing in a deposition zone a coating of pore-free copper onto said metal to form a copper foil;
d. stripping said copper foil from said metal layer in a separation zone;
e. chemically removing the plateable layer from said belt in a cleaning zone in a manner to substantially preserve the structural integrity of the belt; and
f. repeating the above steps a plurality of times, whereby a continuous method for producing copper foil is provided.

2. The improved method of claim 1 wherein said zones are physically separated from one another.

3. The improved method of claim 1 wherein said method is substantially continuous, and wherein said depositing comprises electroplating, and wherein said layer comprises a plateable layer.

4. The improved method of claim 3 wherein said removing and said reforming of said plateable layer is carried out periodically as needed to maintain the quality of said copper foil produced by said method and wherein said depositing and said stripping of said copper foil are carried out continuously and at about constant speed.

5. The improved method of claim 4 wherein at least one of said zones is in duplicate so as to assure steady continuous operation of said method.

6. The improved method of claim 5 wherein essentially all said zones are in pairs of duplicates so as to enable steady long-term continuous operation of said method.

7. The improved method of claim 6 wherein means are provided in association with each of said zones for shunting said belt from one member of a pair of said zones to the other member of said pair without loss of processing speed.

8. The improved method of claim 3 wherein the exposed surface of said copper foil deposited on said belt in said deposition zone is treated in a separate bonding zone to increase its bondability to plastics before said foil is stripped from said belt in said separation zone.

9. The improved method of claim 8 wherein said copper foil in said bonding zone is subject to controlled electroplating which generates a plurality of projections on said exposed surface.

10. The improved method of claim 3 wherein said zones include a series of tanks spaced along the pathway of said belt, wherein said belt is driven along said pathway at controlled speed, and wherein said belt is moved in and out of contact with said tanks to effect efficient continuous manufacture of said copper foil at a speed which can be maintained constant.

11. The improved method of claim 3 wherein said surface of said belt is at least periodically roughened before said forming of said fresh plateable layer thereon so as to cause said plateable layer and said copper foil deposited thereon to conform to said roughened surface, said roughening being controlled so as to increase bondability of said copper foil to plastics without disrupting the continuity of said copper foil when stripped from said plateable layer.

12. The product formed by the method as set forth in claim 1.

* * * * *